United States Patent [19]

Quinlan, Jr.

[11] Patent Number: 4,947,353

[45] Date of Patent: Aug. 7, 1990

[54] AUTOMATIC VEHICLE DETECTING SYSTEM

[75] Inventor: Thomas J. Quinlan, Jr., Beach Haven Terrace, N.J.

[73] Assignee: Automatic Toll Systems, Inc., Teterboro, N.J.

[21] Appl. No.: 243,295

[22] Filed: Sep. 12, 1988

[51] Int. Cl.[5] ..... G08G 1/017; G08G 1/02; G08G 1/04

[52] U.S. Cl. ..... 364/562; 235/384; 250/222.1; 340/942; 364/560; 377/9; 382/1

[58] Field of Search ..... 250/222.1; 235/31, 384; 340/942; 364/562, 550; 377/9; 382/1

[56] References Cited

U.S. PATENT DOCUMENTS

| | | | |
|---|---|---|---|
| 2,967,948 | 1/1961 | Pratt | 250/222.1 |
| 2,971,096 | 2/1961 | Pratt | 377/9 |
| 3,488,510 | 1/1970 | Chelmsford et al. | 250/222.1 |
| 3,705,976 | 12/1972 | Platzman | 235/384 |
| 3,748,443 | 7/1973 | Kroll et al. | 377/9 |
| 3,794,966 | 2/1974 | Platzman | 340/98 |
| 3,927,389 | 12/1975 | Neeloff | 340/940 |
| 4,247,768 | 1/1981 | Elmer et al. | 364/562 |
| 4,433,325 | 2/1984 | Tanaka et al. | 340/937 |
| 4,493,103 | 1/1985 | Yamashita et al. | 382/1 |
| 4,652,729 | 3/1987 | Kubota et al. | 235/384 |

*Primary Examiner*—Parshotam S. Lall
*Assistant Examiner*—Edward R. Cosimano
*Attorney, Agent, or Firm*—Curtis, Morris & Safford

[57] ABSTRACT

An automatic vehicle detection system within a toll collecting system has a scanning laser unit positioned on one side of a roadway, a vertical photoelectric detector on the opposite side of the roadway and a treadle extending across the roadway. The laser beam scans the height of the detector at regular intervals, and the detector produces a first signal indicative of a vertical dimension of an object (car or truck) intercepting the laser beam. The treadle detects each set of wheels and produces a second signal indicative of a horizontal length of the object. A control circuit uses the first and second signals to generate a count of the number of objects and to categorize each object as one of a plurality of known vehicles.

9 Claims, 2 Drawing Sheets

AUTOMATIC VEHICLE DETECTING SYSTEM

FIELD OF THE INVENTION

The present invention relates generally to automatic toll collection systems and more specifically is directed to an automatic vehicle detecting system for deriving a count of vehicles successively proceeding along a roadway.

BACKGROUND OF THE INVENTION

In the automatic toll collection industry, it is necessary to accurately identify each vehicle passing along the roadway in order to determine the number and amount of tolls due. Without a human toll collector, the automatic machinery must be able to discriminate and to categorize the different types of vehicles. For instance, it must be able to categorize a vehicle as a car or a truck, or as a truck of a particular size, if different tolls are to be levied.

Another problem is discriminating a car pulling a trailer on a trailer hitch, which may be detected as two separate vehicles requiring two tolls, while a first car closely tailgating a second car might be sensed as a single vehicle. Conventional loop detectors, which detect the presence of large metallic objects (i.e. cars and trucks) from a changing magnetic field, have proved less than completely satisfactory in distinguishing between these two situations.

While optical vehicle detection devices have been employed, they are prone to problems from reflected sunlight which interferes with a scanning light beam. An example of such an optical detector is shown in U.S. Pat. No. 2,697,948 (Pratt) in which a stationary fluorescent light directs a light beam across a roadway to a phototube and cooperates with a treadle positioned in the ground across the roadway to detect and classify vehicles. This patent recognizes that under its own construction it is necessary to have a source of light of unvarying intensity. While the Pratt system compensates for fog or haze by ignoring a gradual light intensity change, there remains the problem of clouds moving across the sun and creating rapid changes in the intensity of light received by the scanning device.

Furthermore, in discriminating and categorizing vehicles, it is sometimes necessary to identify even relatively small objects which intercept the scanning beam. An example of such a small object is a trailer hitch, which must be accurately detected to discriminate between the car/trailer combination and the two car tailgating situation mentioned above. The scanning beam must be adapted for precise detection over a range of small to large objects so as to adequately discriminate between these two situations.

OBJECTS AND SUMMARY OF THE INVENTION

Accordingly, it is an object of the present invention to provide an automatic vehicle detecting system which avoids the above-described difficulties of the prior art.

It is another object of the present invention to provide an automatic vehicle detecting system which provides accurate detection of the vertical dimension and horizontal length of an object moving along a roadway.

It is another object of the present invention to provide an automatic vehicle detecting system which utilizes a laser beam for accurate detection of the vertical dimension of the objects.

It is still another object of the present invention to provide an automatic vehicle detection system in which each object intercepting the laser beam is categorized as one of a plurality of known vehicles.

In accordance with an aspect of the present invention, an automatic vehicle detecting system comprises laser means positioned at one side of a roadway for continuously directing a laser beam across the roadway so as to intercept the path of an object moving along the roadway, and elongated photoelectric means positioned vertically on an opposite side of the roadway from the laser means for detecting a presence and absence of the laser beam and providing a first signal indicative thereof. The laser means repeatedly sweeps the laser beam along the length of the photoelectric means at regular intervals such that a detected absence of the laser beam along a predetermined incremental length of the photoelectric means is indicative of a corresponding vertical dimension of an object on the roadway and intercepting the laser beam. The automatic vehicle detecting system further comprises treadle means extending across a surface of the roadway between the laser means and the photoelectric means for detecting a horizontal length of an object moving over the treadle means and providing a second signal indicative of the horizontal length, and control means receiving the first and second signals for deriving a count of objects successively intercepting the laser beam.

Advantageously, the control means is responsive to the first and second signals to identify the presence of an object when the corresponding vertical dimension is at least a minimum height and is spaced from an upper surface of the roadway by at least a minimum distance and no more than a maximum distance. To properly distinguish a trailer hitch, the minimum height may be two inches, the minimum distance ten inches and the maximum distance forty-eight inches.

In accordance with a further aspect of the present invention, the control means includes categorization means for categorizing each object intercepting the beam as one of a plurality of known vehicles in response to the first and output signals. The categorization means includes memory means for storing a plurality of patterns respectively corresponding to the plurality of known vehicles, each pattern identifying at least a horizontal length and a vertical dimension of the respective known vehicle. The categorization means compares the vertical dimension and horizontal length indicated by the first and second signals with the vertical dimensions and horizontal lengths identified by the patterns so as to categorize each object as one of the known vehicles.

These and other objects, aspects and features of the present invention will become apparent from the following detailed description of a preferred embodiment thereof taken in connection with the accompanying drawings, throughout which like reference numerals denote like elements and parts.

DETAIL DESCRIPTION OF THE PREFERRED EMBODIMENT

Figure 1:
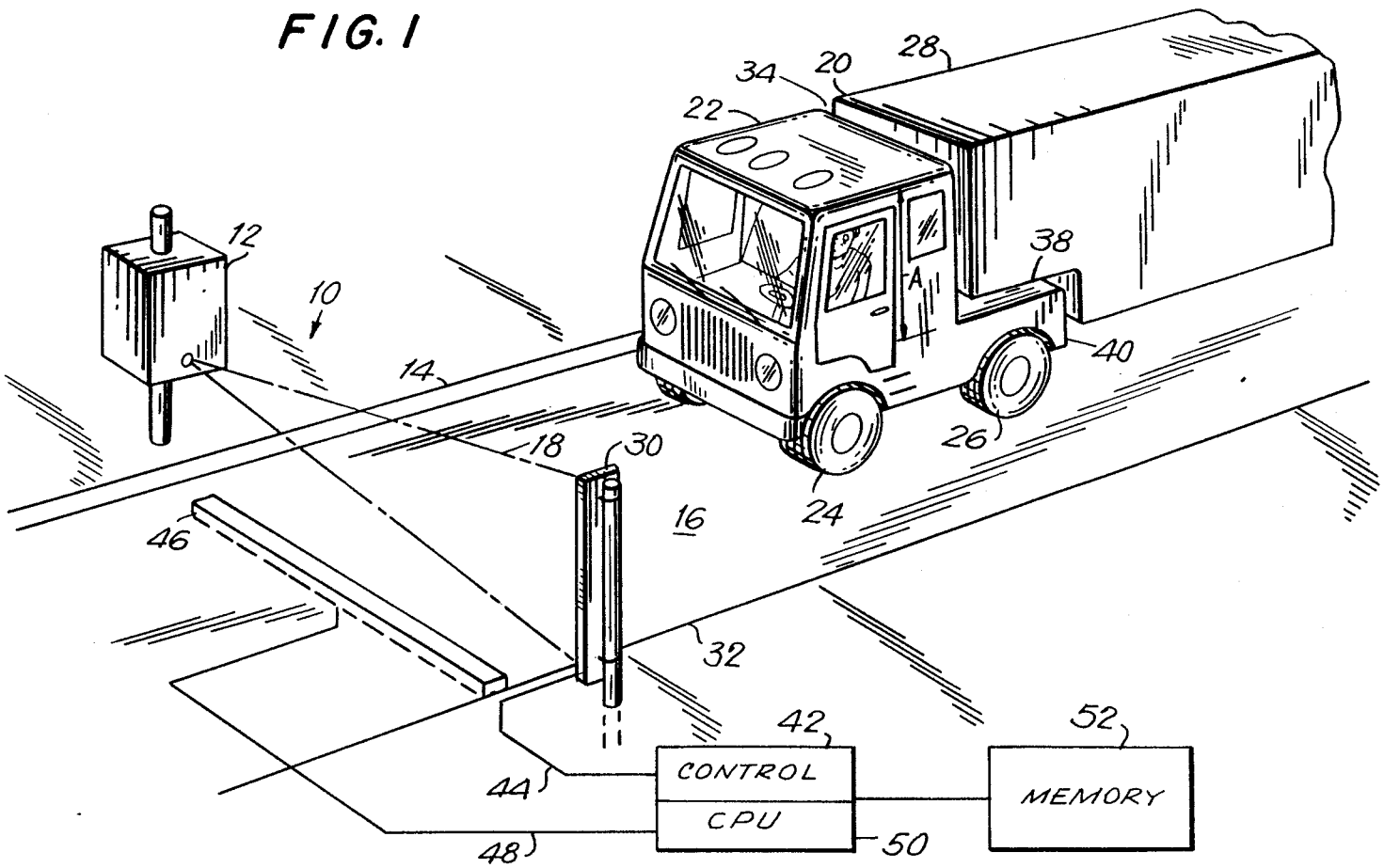
FIG. 1 is a schematic illustration of an embodiment of the automatic vehicle detecting system in accordance with the present invention as installed on a roadway.

Turning now to the drawings and initially to FIG. 1 thereof, the automatic vehicle detecting system 10 in accordance with the present invention includes a laser scanning unit 12 positioned at one side 14 of a roadway 16 for continuously directing a laser beam 18 across roadway 16 so as to intercept the path of an object moving along roadway 16. The particular "object" illustrated in FIG. 1 is a truck 20 having a tractor 22 with forward and rear sets of wheels 24, 26 and a trailer 28 having a rear set of wheels (not illustrated). Trailer 28 is connected to tractor 22 by a trailer hitch (not illustrated), which is conventionally about 2–3 inches in height and between ten and forty-eight inches from the ground.

System 10 further includes an elongated photoelectric light detector 30 positioned vertically on the opposite side 32 of the roadway 16 from the side 14 at which laser scanning unit 12 is positioned. Detector 30 may be, for example, a photoelectric tube and the like and may utilize a reflective channel to receive and detect the incident laser beam 18. In particular, detector 30 is adapted to detect either the presence or the absence of laser beam 18 along its vertical length so as to produce a first signal indicative of the presence and absence of the laser beam at each point along detector 30. Laser scanning unit 12 repeatedly sweeps laser beam 18 along the length of light detector 30 at regular intervals such that a detected absence of laser beam 18 along a predetermined incremental length of detector 30 is indicative of a corresponding vertical dimension of the object on roadway 16 and intercepting laser beam 18.

Thus, when truck 20 has moved forward to the point where tractor 22 intercepts laser beam 18, laser beam 18 will be repeatedly absent from all points on detector 30 corresponding to the height of tractor 22 and present only at those points, if any, where laser beam 18 passes above or below tractor 22. The first signal will be indicative of these points of absence/presence. As truck 20 continues to move forward along roadway 16, laser beam 18 will pass through a vertical gap 34 between tractor 22 and trailer 28. In the illustrated example, detector 30 will detect the presence of laser beam 18 along a length corresponding to the height A of tractor 22 above its base.

As truck 20 proceeds still further along roadway 16, trailer 28 will now intercept laser beam 18 along the upper portions of light detector 30 while permitting passage of laser beam 18 through horizontal gap 38. Thereafter, laser beam 18 will pass through to light detector 30 only through vertical gap 40 and then will be intercepted by trailer 28 until truck 20 has passed completely by laser beam 18.

Laser scanner unit 12 directs laser beam 18 successively from the top to bottom of detector 30 and back again sufficiently rapidly so that the configuration, including the horizontal length and vertical dimension of each object, or portion thereof, may be accurately discriminated. It has been found that using laser beam 18 to scan the length of detector 30 approximately 160 times per second is an appropriate scanning rate for this purpose.

Thus, as truck 20 moves along roadway 16 by laser scanner 12, laser beam 18 will trace out the elevational configuration of truck 20 to provide successive values for its vertical dimensions. System 10 may be designed to recognize objects of less than a certain height as cars, rather than trucks, so that the information on the vertical dimension alone of the object is valuable in categorizing the object as one of a plurality of known vehicles. This information, in the form of the first signal, is provided to a control circuit 42 over a cable 44.

An advantageous aspect of system 10 is the use of coherent laser beam 18 to accurately detect a gap between objects so as to discriminate between a single composite object and two successive but separate objects. In a composite object such as truck 20, there will never be a complete gap between tractor 22 and trailer 28 along the entire scanning range of laser beam 18. Instead, a trailer hitch, whether extending vertically through horizontal gap 38 or horizontally through vertical gaps 34 or 40, will always be present to intercept laser beam 18 and to cause detector 30 to detect an absence of laser beam 18 from some portion of its length. With two separate vehicles, on the other hand, it is highly unlikely that the two will be driven so closely together as to be in light proof contact over a significant vertical dimension of, for example at least one to two inches. The coherent nature of laser beam 18 permits a more accurate detection of small objects than does a non-coherent light beam, and further will be unaffected by changes in the ambient light.

System 10 further includes a treadle 46 which extends across, and is advantageously embedded in, the surface of roadway 16 so as to detect the passage thereover of each set of wheels of each object. Advantageously, treadle 46 is aligned with laser scanner unit 12 and detector 30, although it need only be positioned across roadway 16 at a known point between the two. Treadle 46 conventionally produces an output signal which changes with the passage of each set of wheels thereover. Thus, by providing a signal each time a set of wheels passes thereover, treadle 46 provides a second signal which is indicative of the lengths between the sets of wheels, which in turn is indicative of a horizontal length of the object. The second signal is also provided to control circuit 42 over a second cable 48.

Control circuit 42, which advantageously may be microprocessor based, derives a count of the objects successively intercepting laser beam 18 from the first signal by distinguishing as separate objects those which permit the complete passage of laser beam 18 along the entire length of detector 30.

However, control circuit 42 can do more than merely count the number of objects successively intercepting laser beam 18, and in fact can categorize each object intercepting laser beam 18 as one of a plurality of known vehicles in response to the first and second signals. Control circuit 42 includes a CPU 50 or other data processing circuits which use the vertical dimension and horizontal length information container in the first and second signals to match each object to one of the known vehicles. The horizontal length of the object may be accurately defined from the second signal by combining the lengths between sets of wheels, as indicated by the second signal, for so long as the first signal indicates a continuous object. Thus, in the illustrated embodiment, the horizontal length of truck 20 would include both the length from front wheels 24 to rear wheels 26 of tractor 22, and the length from rear wheels 26 to the rear wheels of trailer 28.

In the illustrated embodiment, a memory 52 is provided which stores a plurality of patterns respectively corresponding to the plurality of known vehicles, with each pattern identifying at least the horizontal length and vertical dimension of the respective known vehicle. In its simplest form, each pattern may consist of a rectangle whose height and length is stored in memory 52. CPU 50 then categorizes each object by comparing its vertical dimension and horizontal length indicated by the first and second signals with the vertical dimensions and horizontal length identified by the patterns so as to categorize the object. The object may then be categorized as the known vehicle whose rectangle most closely matches the outer dimensions of the object. It will be understood, of course, that more sophisticated pattern/identification recognition schemes may be employed.

Figure 2:
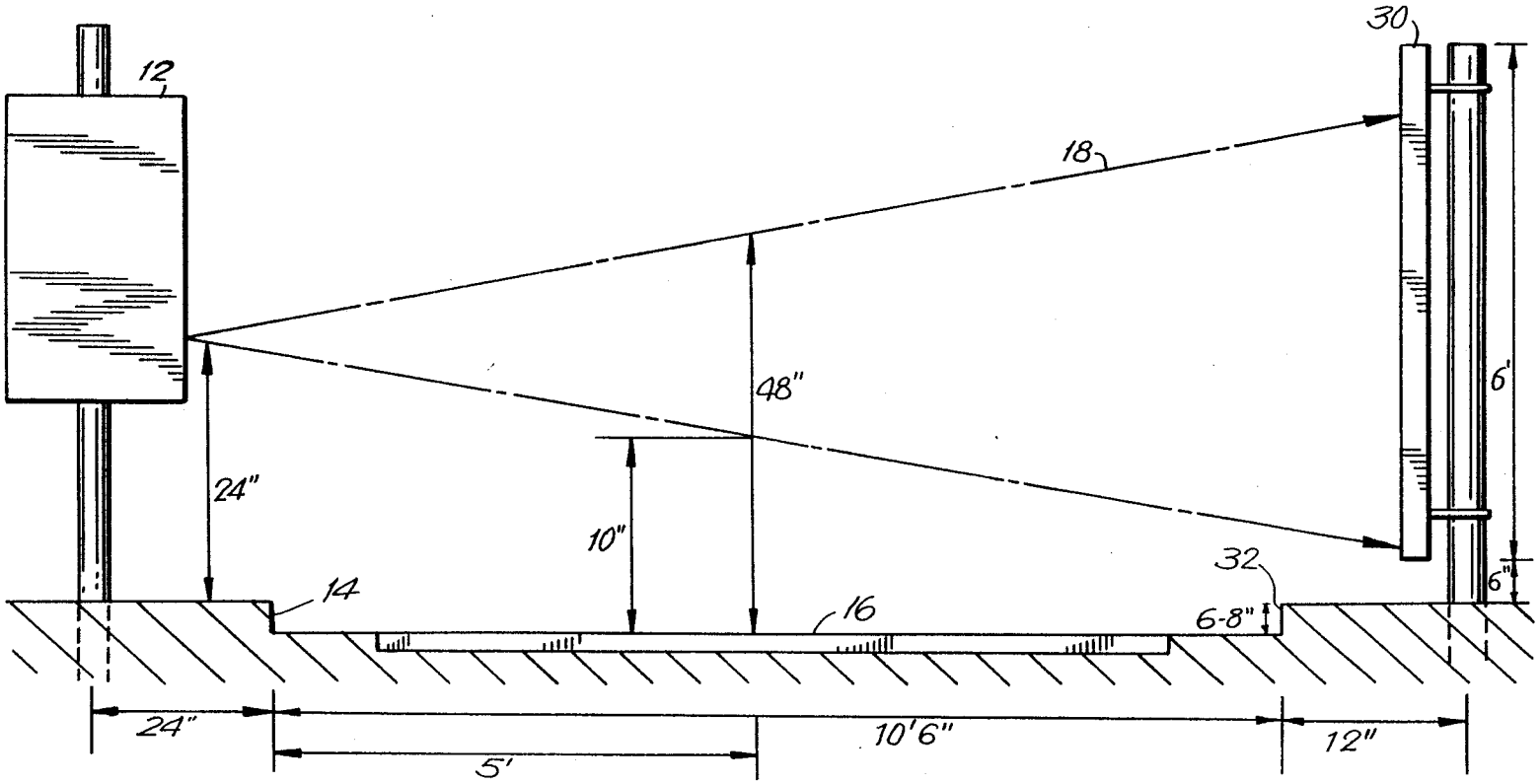
FIG. 2 is a side elevational view of the system of FIG. 1.

FIG. 2 illustrates advantageous dimensions for system 10 so as to optimize the probability that each object will be accurately detected and categorized. In the illustrated embodiment, roadway 16 is 10 feet 6 inches wide, with laser scanning unit 12 being positioned 24 inches from side 14 of roadway 16. Laser beam 18 is emitted from a height of 24 inches and is scanned across detector 30 over a distance of 60 inches. Detector 30 is 6 inches from the ground and 12 inches from side 32 of roadway 16. As a result, at the center of roadway 16, laser beam 18 scans from 10 inches above the surface of roadway 16 up to forty-eight inches therefrom. Experience has shown that virtually all vehicles will present a light proof surface of at least 2 inches in height within this range. Advantageously, control circuit 42 will disregard any object of less than 2 inches within this range to eliminate any erroneous detections.

The present invention has been described in connection with a single preferred embodiment, but it will be apparent to those of ordinary skill in the art that many changes and modifications may be made therein without departing from the spirit and scope of the present invention, which is to be determined by reference to the appended claims.

What is claimed is:

1. An automatic vehicle detecting system comprising:

laser means positioned at one side of a roadway for continuously directing a laser beam of coherent light across the roadway so as to intercept the path of an object moving along the roadway;

elongated photoelectric means positioned vertically on an opposite side of said roadway from said laser means for detecting a presence and absence of said laser beam and providing a first output signal indicative thereof;

said laser means repeatedly sweeping said laser beam along the length of said photoelectric means at regular intervals such that a detected absence of said laser beam along a predetermined incremental length of said photoelectric means is indicative of a corresponding vertical dimension of an object on said roadway and intercepting said laser beam;

treadle means extending across a surface of said roadway between said laser means and said photoelectric means for detecting a horizontal length of an object moving over said treadle means and providing a second output signal indicative of said horizontal length; and control means receiving said first output signal and said second output signal for deriving a count of objects successively intercepting said laser beam.

2. A system according to claim 1, wherein said laser beam scans the length of said photoelectric means approximately 160 times per second.

3. A system according to claim 1, wherein said photoelectric means comprises a photoelectric tube.

4. A system according to claim 1, wherein said control means is responsive to said first output signal to identify the presence of an object only when said corresponding vertical dimension of said object is at least a minimum height and said object is spaced from an upper surface of said roadway by at least a minimum distance and no more than a maximum distance.

5. A system according to claim 4, wherein said minimum height is two inches, said minimum distance is ten inches and said maximum distance is forty-eight inches.

6. An automatic vehicle detecting system comprising:

laser means positioned at one side of a roadway for continuously directing a laser beam of coherent light across the roadway so as to intercept the path of an object moving along the roadway;

elongated photoelectric means positioned vertically on an opposite side of said roadway from said laser means for detecting a presence and absence of said laser beam and providing a first output signal indicative thereof;

said laser means repeatedly sweeping said laser beam along the length of said photoelectric means at regular intervals such that a detected absence of said laser beam along a predetermined incremental length of said photoelectric means is indicative of a corresponding vertical dimension of an object on said roadway and intercepting said laser beam;

treadle means extending across a surface of said roadway between said laser means and said photoelectric means for detecting a horizontal length of an object moving over said treadle means and providing a second output signal indicative of said horizontal length; and control means receiving said first output signal and said second output signal for deriving a count of objects successively intercepting said laser beam, said control means including categorization means for categorizing each object intercepting said beam as one of a plurality of known vehicles in response to said first and second output signals.

7. A system according to claim 6, wherein said categorization means includes memory means for storing a plurality of patterns respectively corresponding to said plurality of known vehicles, each said pattern identifying at least a horizontal length and a vertical dimension of the respective known vehicle, said categorization means further including means for comparing the vertical dimension and horizontal length indicated by said first and second output signals with the vertical dimensions and horizontal lengths identified by said patterns so as to categorize each object as one of said known vehicles.

8. An automatic vehicle detecting system comrpsiing:

laser means positioend at one side of a roadway for continuously directing a laser beam of coherent light across the roadway so as to intercept the path of an object moving along the roadway;

elongated receptor means positioned vertically on an opposite side of said roadway from said laser;

means for detecting a presence and absence of said laser beam of said receptor means and providing a first output signal indicative thereof;

repeatedly sweeping said laser beam along the length of said receptor means at regular interval such that a detected absence of said laser beam along a predetermined incremental length of said receptor means is indicative of a corresponding vertical dimension of an object on said roadway and intercepting said laser beam;

treadle means extending across a surface of said roadway between said laser means and said receptor means for detecting a horizontal length of an object moving over said treadle means and providing a second output signal indicative of said horizontal length; and control means receiving said first output signal and said second output signal for deriving a count of objects successively intercepting said laser beam.

9. A system according to claim 8, wherin said control means includes categorization means for categorizing each object intercepting said beam as one of a plurality of known vehicles in response to said first and second output signals.

* * * * *